US006760988B2

(12) United States Patent
Bardeleben

(10) Patent No.: US 6,760,988 B2
(45) Date of Patent: Jul. 13, 2004

(54) NOVELTY DEVICE FOR MOUNTING ON A VEHICLE ANTENNA

(76) Inventor: William C. Bardeleben, 89589 Shorelane Dr., Lawton, MI (US) 49065

( * ) Notice: Subject to any disclaimer, the term of this patent is extended or adjusted under 35 U.S.C. 154(b) by 0 days.

(21) Appl. No.: 10/303,270

(22) Filed: Nov. 25, 2002

(65) Prior Publication Data

US 2004/0098893 A1 May 27, 2004

(51) Int. Cl.[7] ..... G09F 21/04
(52) U.S. Cl. ..... 40/591; 40/411
(58) Field of Search ..... 40/412, 413, 591

(56) References Cited

U.S. PATENT DOCUMENTS

| | | | | |
|---|---|---|---|---|
| 1,380,325 A | | 5/1921 | Schlirf | |
| 1,798,052 A | | 3/1931 | Addition | |
| 1,899,788 A | | 2/1933 | Baldwin | |
| 2,693,044 A | | 11/1954 | Roemisch | |
| 2,810,223 A | | 10/1957 | Fraesdorf, Jr. | |
| 3,073,047 A | | 1/1963 | Jones | |
| 3,221,440 A | * | 12/1965 | Gutierrez | 446/201 |
| 3,359,670 A | | 12/1967 | Pyc et al. | |
| 3,636,912 A | * | 1/1972 | Kamp | 116/28 R |
| 3,757,730 A | | 9/1973 | Douglas | |
| 3,758,190 A | | 9/1973 | Douglas | |
| 3,983,653 A | | 10/1976 | Paige | |
| 4,041,452 A | | 8/1977 | Moya | |
| 4,103,924 A | | 8/1978 | Suhm | |
| 5,267,525 A | | 12/1993 | Person et al. | |
| 5,323,728 A | | 6/1994 | Hjelm | |
| 5,363,792 A | | 11/1994 | Petechik | |
| D362,199 S | | 9/1995 | Evans | |
| 6,195,923 B1 | * | 3/2001 | Gorman | 40/479 |

* cited by examiner

*Primary Examiner*—S. Joseph Morano
*Assistant Examiner*—Robert J. McCarry, Jr.
(74) *Attorney, Agent, or Firm*—Welsh & Katz, Ltd.

(57) ABSTRACT

A novelty device for mounting on an elongated support member such as a vehicle antenna which comprises a shaft having a hollow portion at a first end to receive the support member, the inner diameter of the hollow portion of said shaft being greater than the greater diameter of the top portion of the support member and smaller than the diameter of the top end of the support member, said shaft having two or more resilient members disposed at a second end thereof. The novelty device includes one or more display members having indicia or an image disposed thereon, which are received with the two or more resilient members and projecting therefrom. The novelty device further includes a bearing insert, which is received with the hollow portion of the shaft, and has a longitudinal channel defined therein for receiving a portion of the elongated support member. The novelty further includes a cap adapted for pressing onto the second end of the shaft to detachably secure the display members to the shaft. These display members impart a full comprehension of the indicia or image disposed thereon regardless of the speed of rotation of the device.

4 Claims, 2 Drawing Sheets

NOVELTY DEVICE FOR MOUNTING ON A VEHICLE ANTENNA

FIELD OF THE INVENTION

The present invention generally relates to novelty devices designed for attachment to a supporting element and, more particularly, to a novelty device that is designed to be attached to a vehicle antenna or the like and to produce a hologram type effect while rotating due to airflow that is caused, for example, by motion of motor vehicle.

BACKGROUND OF THE INVENTION

Various novelty or visual indicating devices are known. As one example, U.S. Pat. No. 1,380,325, which issued on May 31, 1921, discloses a toy wind-wheel. This patent generally discloses certain improvements in toy wind-wheels, and states that its principal object is to provide wind-wheels which will be oppositely rotated through the action of the wind upon the blades thereof.

As another example, U.S. Pat. No. 1,798,052, which issued on Mar. 24, 1931, discloses a warning signal. This patent generally discloses a warning signal that is particularly adapted to be carried by wagons and the like, and states that one of its primary objects is to provide a warning signal of such class by means of which the light rays from an approaching automobile are reflected to instantly warn the operator of the automobile of the proximity of the wagon or the like. One advantage of this is the reduction of the likelihood of a collision.

U.S. Pat. No. 1,899,788, which issued on Feb. 28, 1933, is entitled animated wind toy. This patent discloses an animated wind toy in which a wind wheel is mounted on an end of a rotary shaft. A mechanism is mounted at the opposite end for supporting a panel with its faces extending in a plane substantially coinciding with the axis of the shaft.

U.S. Pat. No. 2,693,044, which issued on Nov. 2, 1954, is entitled wind-driven highway marker. This patent generally relates to a rotatable highway marker actuated by prevailing air currents.

U.S. Pat. No. 2,810,223, which issued on Oct. 22, 1957, is entitled animated signs. This patent generally relates to a mechanical sign which is animated through rotation about a generally vertical axis and which includes a supporting frame structure for simple and easy mounting at an intended point of use.

U.S. Pat. No. 3,073,047, which issued on Jan. 15, 1963, is entitled animated sign. This patent generally relates to a display sign structure rotatable about a generally vertical axis by currents of air.

U.S. Pat. No. 3,221,440, which issued on Dec. 7, 1965, is entitled wind operated toy. This patent generally relates to a wind-operated toy simulating an insect or the like. The toy is rotatably mounted on a shaft attached to an elongated handle. Two bearings are provided to reduce friction, improve rotation of the toy around the shaft, and retain the toy on the shaft.

U.S. Pat. 3,359,670, which issued on Dec. 26, 1967, is entitled advertising device. This patent generally relates to an advertising device of the wind spinner type adapted to be mounted on a vehicle antenna and constructed of a single sheet of resilient material such as sheet plastic.

U.S. Pat. No. 3,636,912, which issued on Jan. 25, 1972, is entitled device for attachment to an elongated support extending from a vehicle. This patent generally relates to a device which is used for indicating the location of the vehicle and for serving as an advertising medium. This device includes a rigid portion visible form all directions and a variety of types of elements for gripping the external surface of the support to secure the device thereto.

U.S. Pat. No. 3,757,730, which issued on Sep. 11, 1973, is entitled wind actuated device. This patent generally relates to a device having a critical stationary wind shield which serves in combination with other features of the device to promote desired wind actuated rotation of a rotatable part.

U.S. Pat. No. 3,758,190, which issued on Sep. 11, 1973, is entitled jumping reflex-reflection. This patent discloses certain eye-catching attention getting devices. These devices have at least one primary rotatable part, an axis means for establishing a predetermined axis of rotation of the primary rotatable part, an holding means for the axis means to permit the rotation, especially a wind-actuated rotation.

U.S. Pat. No. 3,983,653, which issued on Oct. 5, 1976, is entitled rotary disseminator. This patent discloses a rotary disseminator that is responsive to even minute vertical air currents. The disseminator is a perfectly balanced vane rotor supported for rotation about a vertical axis by a filamental shaft.

U.S. Pat. No. 4,041,452, which issued on Aug. 9, 1977, is entitled a rotating beacon for a bicycle. This patent generally relates to a visually detectable device particularly suited for use by cyclists in attracting the attention of others, particularly motorists. The device is characterized by a flexible staff adapted to be mounted on a bicycle, a transparent housing rotatably mounted on the staff, and a lamp and reflector mounted in the housing for directing there from a sweeping beam from the housing.

U.S. Pat. No. 4,103,924, which issued on Aug. 1, 1978, is entitled vehicle safety device. The patent generally relates to a device for use with a bicycle adapted to be mounted adjacent the rear end thereof. The device includes an upstanding flexible mounting shaft, preferably made of a polymeric material, detachably connected at one end to the vehicle and at he other end adapted to mount a signal device.

U.S. Pat. No. 5,267,525, which issued on Dec. 7, 1993, is entitled reflector device. The patent generally relates to a device for attracting the attention of an observer having a first and second pairs of arms mounted on a body at different elevations and at right angles to each other with air scoops and light reflectors on each of the arms so that the motion of air relative to the device will produce flashes of light alternatively in the planes of the first and second pairs of arms.

U.S. Pat. No. 5,323,728, which issued on Jun. 28, 1994, is entitled warning sign. The patent generally discloses a triangular warning sign mounted in a rotatable manner via a shaft in a foot, in that two side edges on the sign facing away from the foot are bent to provide flanges. These flanges face in mutually opposing directions, whereby the sign when used outdoors can be influenced by the wind and rotate. The sign thus becomes visible from all sides.

U.S. Pat. No. 5,363,792, which issued on Nov. 15, 1994, is entitled safety signal light. The patent generally discloses a safety signal kit that includes a hub and a plurality of vanes selectively mounted on the hub. The hub is selectively mounted on a firs tend of a shaft. A second end of the shaft is selectively secured to a base. The base can be an elongated body having a socket located adjacent a first end thereof and a recess located adjacent a second end thereof.

U.S. Pat. No. Des. 362,199, which issued on Sep. 12, 1995, is entitled water skier safety flag. This patent discloses an ornamental design for a skier safety flag.

U.S. Pat. No. 6,195,923, which issued on Mar. 6, 2001, is entitled display method and structure. This patent generally discloses a display structure or a unique book including a plurality of laterally extending page supports each adapted to carry at least a pair of pages in a side-by-side relationship. This display structure includes a rotatably supporting provided for each of the page supports so that when one of the support pallets is rotated, the other of the pair is rotated in tandem therewith.

Numerous patents are discussed in the preceding paragraphs of this application. All of such patents are incorporated by reference into this application as if fully set forth herein. All of the devices disclosed in such patents appear to be satisfactory for their intended purposes. However, improvements are desired.

BRIEF DESCRIPTION OF THE DRAWINGS

The invention, together with the advantages thereof, may be understood by reference to the following description in conjunction with the accompanying figures, which illustrate some embodiments of the invention.

DETAILED DESCRIPTION OF THE INVENTION

Figure 1:
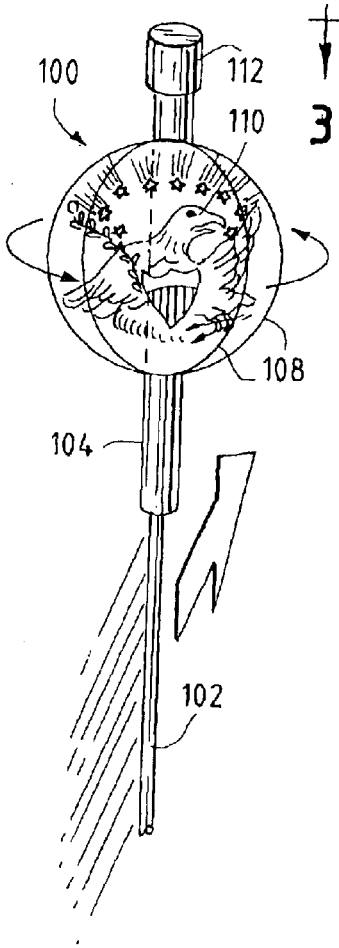
FIG. 1 is a perspective view of a novelty device that incorporates aspects of the present invention.

While the present invention is susceptible of embodiments in various forms, there is shown in the drawings and will hereinafter be described a presently preferred embodiment with the understanding that the present disclosure is to be considered an exemplification of the invention and is not intended to limit the invention to the specific embodiments illustrated.

It should be further understood that the title of this section of this specification, namely, "Detailed Description of the Invention", relates to a requirement of the United States Patent Office, and does not imply, nor should it be inferred to limit the subject matter disclosed herein.

In the present disclosure, the words "a" or "an" are to be taken to include both the singular and the plural. Conversely, any reference to plural items shall, where appropriate, include the singular.

One object of the present invention is to provide a device which will rotate while supported by an elongated support such as a vehicle antenna with very light wind speed. Another object of the present invention is the provision of a novelty device that may be quickly mounted or dismounted on any vehicle antenna or other similarly accommodating poles/shafts. Still another object of the invention is the provision that the device is of economical construction, and designed to sustain the impact of all possible weather conditions without losing its shape or its ability to rotate. A further object of the present invention is the provision that the device will impart a full comprehension of the image/picture or the message printed, glued or fastened on the vanes of the rotating device regardless of the speed of rotation.

Figure 4:
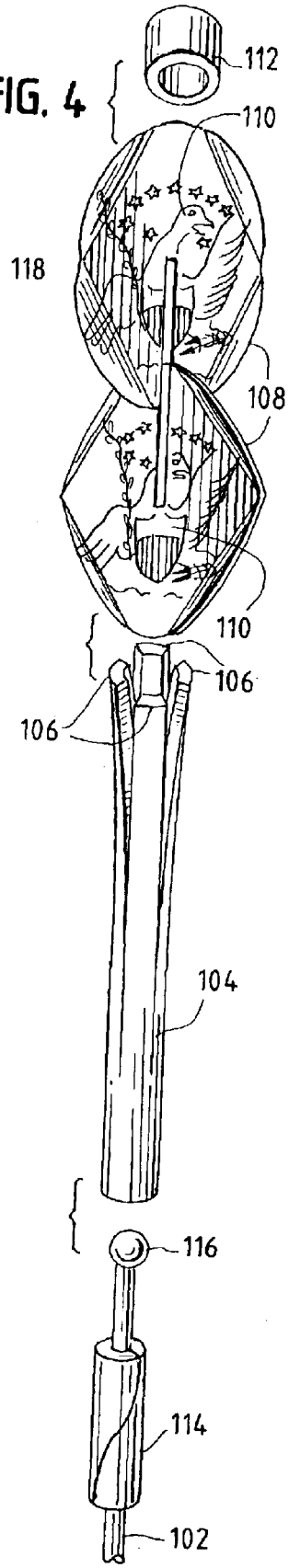
FIG. 4 is an exploded view of the novelty device shown in FIG. 1.

Referring to FIG. 1, a perspective view of a novelty device 100 that incorporates aspects of the present invention is illustrated. Novelty device 100 includes a rotating shaft 104 engaging axially at a first end (a lower end) a vehicle pole/antenna 102. The rotating shaft 104, which may be made of, for example, a synthetic material, such as plastic or of any other weather resistant material, comprises a cylindrical piece with a passageway having a diameter wide enough to accept axially the pole/antenna 102. As shown in FIG. 4, the rotating shaft 104 is cross-cut at a second end (a top end) into four equal vertical sections 106 to accommodate an axial insertion of a pair of synthetic/plastic members 108. Also as shown in to FIG. 4, the synthetic members 108, which are shown to be circular but may be of any desired shape, have vertical end slots 110. The synthetic members 108 may be assembled by engaging the vertical slots 110 together. Once assembled together, the synthetic members 108 are inserted axially from the top end of the shaft 104 to fit within its cross-cut vertical sections 106, and to produce radially extending vanes. The cross-cut vertical sections 106 end at a location intermediate the shaft 104 extremities so as to accommodate axially the vertical length of the plastic members 108, and a cap 112.

Once axially inserted into the cross-cut sections 106 of the rotating shaft 104 for their intended fit, the synthetic members 108 protrude radially from the shaft 104 to reveal/display an image/message 110, and to engage the wind for rotation as, for example, shown in FIG. 1. The cross-cut end of the rotating shaft 104 is received axially within a cap 112 to secure the position of the pair of synthetic members 108. It should be appreciated by those of ordinary skill in the relevant art that any number of synthetic members can be utilized. For example, the present invention contemplates that one synthetic member can be used. In this example, there are two cross-cut vertical sections 106 defined in the rotating shaft 104.

Figure 2:
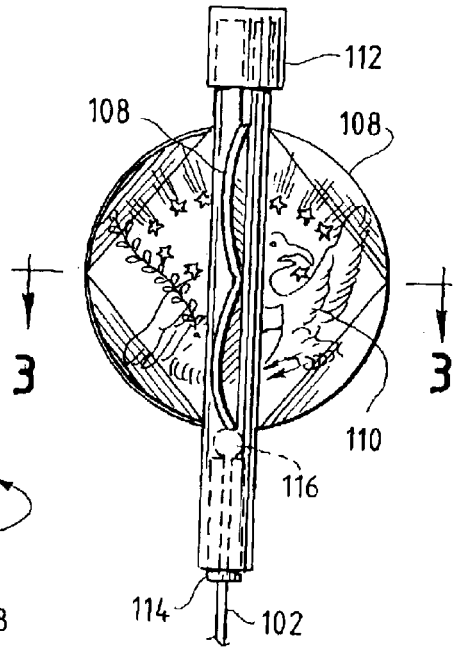
FIG. 2 is a side view of the novelty device shown in FIG. 1.

Referring to FIG. 2, a traverse sectional view of the upper and lower ends of the novelty device 100 that incorporates aspects of the present invention is illustrated. Novelty device 100 includes the rotating shaft 104, which reveals an axially circular passageway adapted to slidably receive the top end 116 of the pole/antenna 102, and hence has a diameter slightly wider than the diameter of the top end 116 of the pole/antenna 102. To securely position the rotating device 100 to the vehicle pole/antenna 102, a bearing insert 114 may be designed with a first inner diameter to accommodate a loose fit around the portion of the pole/antenna immediately below the top end 116 of the pole/antenna 102, and with a second outer diameter to provide a tight securing fit with the inner diameter of the rotating shaft 104.

The lowest sections of the plastic members 108 positioned within the shaft 104 come to rest directly above the top end 116 of the pole/antenna 102, which facilitates rotation and reduces friction. As shown in FIG. 4, the pole/antenna 102 is surrounded loosely by a tubular insert 404, which is designed to fit securely within the inner diameter of the shaft 104. The top extremity of the bearing insert 114 remains below the top end 116 of the pole/antenna 102 to prevent any restriction on the rotation of the shaft 104 around the pole/antenna 102.

Also as shown, the plastic members 108 form four radially extending vanes. In one exemplary embodiment, the four vanes are bent to provide flanges 118. Each flange 118 is oriented toward the center of its respective circular plastic member 108 to improve the influence of the wind on the rotation of the device 100. Further, it is shown a cap 112 receiving axially the cross-cut end sections 106 of the rotating shaft 104 for securing the position of the pair of synthetic members 108.

Figure 3:
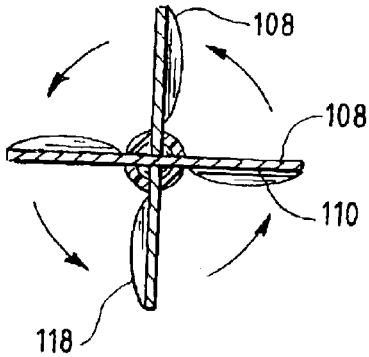
FIG. 3 is a sectional plan view along the line 3—3 of the novelty device shown in FIG. 2.

Referring to FIG. 3, a sectional plan view, along the line 3—3 of the novelty device as shown in FIG. 2 that incorporates aspects of the present invention is illustrated. As shown, there are the two plastic members 108 crossing each other axially through the shaft 104 to display their four vanes, as well as their bent flanges 118. As designed, the flanges 118 are shown facing the opposite direction of rotation to maximize the impact of even very light wind speed conditions.

Referring to FIG. 4, an exploded view of the novelty device 100 shown in FIG. 1 that incorporates aspects of the present invention is illustrated. Novelty device 100 includes a cap 112 designed to receive axially the cross-cut end sections 106 of the rotating shaft 104 for securing the position of the pair of synthetic members 108. The circular plastic members 108 with their respective vertical end slots 110, once assembled together are inserted axially from the top end of the shaft 104 to fit as intended within its cross-cut vertical sections 106. Also as shown, the shaft 104 is designed to accept axially at its lower end passageway the top end 116 of the pole/antenna 102, as well as the bearing insert 114.

Figure 5:
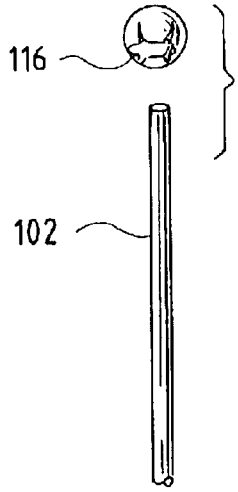
FIG. 5 is a perspective of an elongated support together with a spherical cap that incorporates an aspect of the present invention.

Referring to FIG. 5, a perspective of an elongated support together 502 with a spherical cap 504 that incorporates an aspect of the present invention is illustrated. Most vehicle antenna's include a bead that is provided at an end of thereof. This bead ensures that the novelty device 100 remains rotatably affixed to the antenna. However, some antenna's do not have such a bead. In this application, an elongated support 502, as shown in FIG. 5, may require an additional component such as the spherical cap 504 to facilitate the rotation of the novelty device 100 while fitted on the elongated support 502. The spherical cap 504 is designed to receive the elongated support 502 within it to make up for the lack thereof. The cap 504 is designed to fit securely about the top end of the elongated support 502 by simply squeezing the cap 504 on the elongated support 502.

Figure 6:
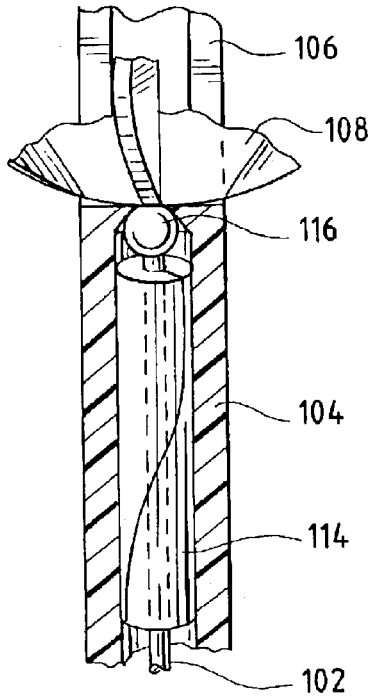
FIG. 6 is a fragmentary vertical section view of the novelty device shown in FIG. 1.

Referring to FIG. 6, a fragmentary vertical section view of the novelty device 100 shown in FIG. 1. As shown, the lower parts of the plastic members 108 come into contact with the top end 116 of the pole/antenna 102. The bearing insert 114 used to fasten the device 100 to the pole/antenna 102 is radially fitted between the shaft 104 and the pole/antenna 102, and is axially fitted between the top end 116 of the pole/antenna 602 and the lower extremity of the shaft 104.

Figure 7:
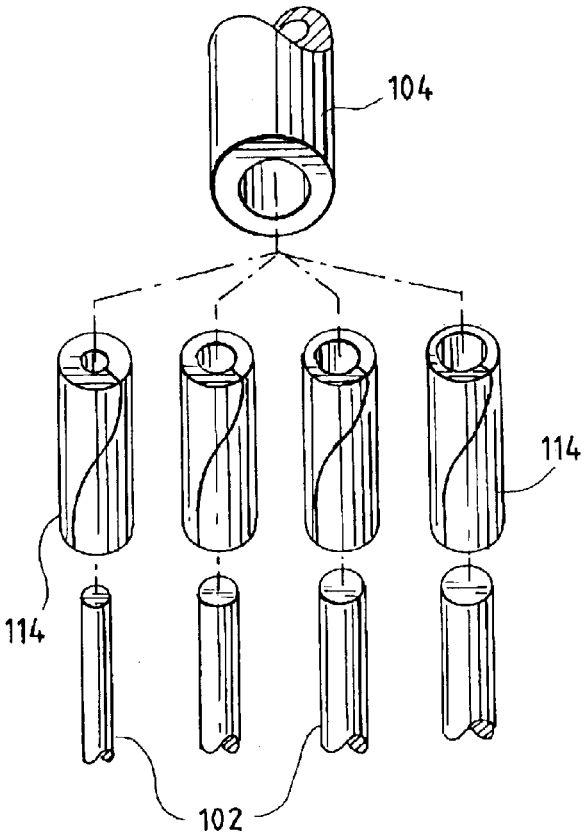
FIG. 7 is a perspective view of a plurality of bearing inserts that are used to fasten the rotating device to a variety of elongated supports that have different outside diameters.

Referring to FIG. 7, a perspective view of a plurality of bearing inserts 114 that are used to fasten the rotating device 100 to a variety of elongated supports 102 that have different outside diameters is illustrated. As shown, the plurality of bearing inserts 114 are designed with inner diameters to accommodate a loose fit around the respective diameters of a plurality of elongated supports 102 to facilitate the rotation of the device 100 when subjected to the influence of the wind. The bearing inserts 114 are also designed to with similar outer diameters for a secure fit that fastens the rotating device 100 to the elongated supports 102. One unique feature of the present invention is that the novelty device 100 may be sold as a "kit" with a number of different bearing inserts included in the "kit." This allows, for example, the user to mount the novelty device 100 on a plurality of different elongated supports that may have different diameters. This adds, for example, to the commercial appeal of the product. The above-referenced spherical cap 504 also can be included in the "kit" to allow the novelty device 100 to be used on antenna's or other elongated supports that do not have any such spherical caps.

Figure 8:
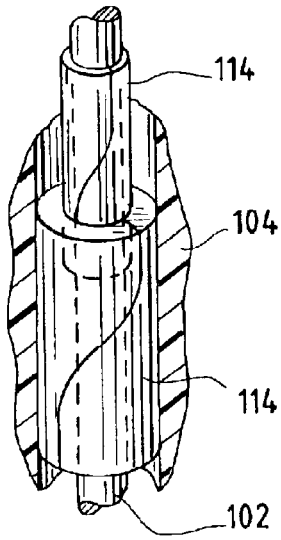
FIG. 8 is a fragmentary vertical section view of a portion of the novelty device shown in FIG. 1.

Referring to FIG. 8, a fragmentary vertical section view of a portion of the novelty device 100 shown in FIG. 1 that incorporates aspects of the present invention is illustrated. This vertical section view displays the engagement of the bearing inserts 114 to both the rotating shaft 104 and the pole/antenna 102. As shown, more than one bearing insert 114 may be needed to accommodate the axial engagement of the rotating shaft 104 and the pole/antenna 102. In this embodiment, two bearing inserts 114 were used to accommodate the comparatively large inner diameter of the shaft 104 with the comparatively small outer diameter of the pole/antenna 102.

It is understood that the plastic members may be designed in any desired shape, and their respective flanges would be bent appropriately. For example, a set of square plastic members would have flanges with faces bent axially towards the rotating shaft.

It is further understood that the vertical top end the rotating shaft may be split, or cross-cut, into any desired number, greater than 2, of vertical sections to accommodate any particular shape of a plastic member or any combination of plastic members.

It should be understood that the present invention is not limited for use in connection with motor vehicle antennas. Rather, the present invention may be used in connection with any application that includes an elongated support. Examples of such further applications include, for example, lawn display applications, rooftop applications, and the like.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A novelty device for mounting on an elongated support member, said novelty device comprising:

a shaft having a hollow portion at a first end thereof for receiving a top portion of the support member, the inner diameter of the hollow portion of said shaft being greater than the largest diameter of the top portion of the support member, said shaft having two or more resilient members disposed at a second end thereof, said two or more resilient members being integrally formed as a portion of said shaft and extending in a direction generally parallel with the axis of the elongated support member;

one or more display members having indicia or an image disposed thereon, said one or more display members further having a generally planar central portion that is inserted between two or more of said two or more resilient members, said one or more display members projecting away from said two or more resilient members;

a bearing insert received with the hollow portion of said shaft, the outer diameter of said bearing insert being approximately equal to the inner diameter of the hollow portion of said shaft so that said bearing insert is press-fit within the hollow portion, said bearing insert having a longitudinal channel defined therein for receiving a portion of the elongated support member;

a cap that is pressed onto said two or more resilient members that are formed on the second end of said shaft, the engagement of said cap to said two or more resilient members detachably secures said one or more display members to said shaft;

wherein said novelty device is mounted on an elongated support member, a distal end of the elongated support member is confined in a space that is defined by said bearing insert, said one or more display members, and an inside surface of the hollow portion of said shaft; and wherein said one or more display members impart a fully comprehension of the indicia or image disposed thereon regardless of the speed of rotation of the device.

2. The novelty device according to claim 1 wherein said display members are bent to trap ambient air currents to impart rotation of said device.

3. The novelty device according to claim 1 wherein said bearing insert when pressed-fitted within the hollow portion of said shaft is positioned so that its upper extremity is distanced axially from the top end of the elongated support to reduce friction during rotation.

4. The novelty device according to claim 1 wherein the elongated support member is topped with a spherical cap to hold the shaft in a rotatably supporting position.

* * * * *